United States Patent [19]

Rosenberg

[11] Patent Number: 4,530,741

[45] Date of Patent: Jul. 23, 1985

[54] AQUEOUS ACID PLATING BATH AND BRIGHTENER COMPOSITION FOR PRODUCING BRIGHT ELECTRODEPOSITS OF TIN

[75] Inventor: William E. Rosenberg, Strongsville, Ohio

[73] Assignee: Columbia Chemical Corporation, Macedonia, Ohio

[21] Appl. No.: 630,363

[22] Filed: Jul. 12, 1984

[51] Int. Cl.[3] ..... C25D 3/32

[52] U.S. Cl. ..... 204/54 R; 204/DIG. 2

[58] Field of Search ..... 204/54 R, 120, 123, 204/44.4, DIG. 2

[56] References Cited

U.S. PATENT DOCUMENTS

| | | | |
|---|---|---|---|
| 3,755,096 | 8/1973 | Passal | 204/54 R |
| 3,875,029 | 4/1975 | Rosenberg et al. | 204/54 R X |
| 3,956,123 | 5/1976 | Rosenberg et al. | 204/54 R |
| 3,977,949 | 8/1976 | Rosenberg | 204/54 R |
| 4,061,547 | 12/1977 | Rosenberg | 204/54 R |
| 4,072,582 | 2/1978 | Rosenberg | 204/54 R |
| 4,242,182 | 12/1980 | Popescu | 204/54 R |
| 4,384,930 | 5/1983 | Eckles | 204/54 R X |
| 4,417,957 | 11/1983 | Rosenberg | 204/54 R |
| 4,459,185 | 7/1984 | Obata et al. | 204/54 R X |

*Primary Examiner*—G. L. Kaplan

*Attorney, Agent, or Firm*—Oldham, Oldham & Weber Co.

[57] ABSTRACT

A tin brightener composition and plating bath utilizes a disubstituted naphthalene having at least one substituted aldehyde group thereon.

13 Claims, No Drawings

AQUEOUS ACID PLATING BATH AND BRIGHTENER COMPOSITION FOR PRODUCING BRIGHT ELECTRODEPOSITS OF TIN

TECHNICAL FIELD

The present invention relates to an aqueous acid electroplating bath for producing bright electrodeposits of tin. Additionally, the present invention relates to a brightening composition which produces uniform deposits over a very broad current density range. The brightener is a disubstituted naphthalene having at least one substituted aldehyde group thereon.

BACKGROUND ART

Plating baths and plating additives heretofore utilized include those set forth in U.S. Pat. No 3,755,096 to Passal; U.S. Pat. No. 3,875,029 to Rosenberg et al; U.S. Pat. No. 3,977,949 to Rosenberg; U.S. Pat. No. 4,061,547 to Rosenberg; and U.S. Pat. No. 4,072,582 to Rosenberg. However, none of these plating baths or tin brighteners are pertinent to the present invention since they do not relate to or suggest the same additives.

DISCLOSURE OF INVENTION

Accordingly, it is an aspect of the present invention to provide a brightening composition which produces uniform bright electrodeposits of tin.

It is another aspect of the present invention to provide a brightener composition as above, wherein the brightener is a disubstituted naphthalene having at least one substituted aldehyde group thereon.

It is yet a further aspect of the present invention to provide a tin plating bath having a brightener, as above, wherein said brightening agent acts synergistically with acrylic acid and methacrylic acid to give uniform bright electrodeposits of tin over a broad current density range.

It is still another aspect of the present invention to provide a tin plating bath, as above, wherein emulsifiers are utilized to disperse the brightening agent.

These and other aspects of the present invention will become apparent from the detailed specification.

In general, a tin plating brightening composition comprises from about 0.5 to about 25 percent by weight of a primary tin brightener, said primary tin brightener being a disubstituted naphthalene having at least one substituted aldehyde group thereon, with said remaining group other than an aldehyde group being selected from the group consisting of methyl, hydroxy methyl, and carboxylic acid; and, from about 1 to about 97 percent by weight of a compound selected from the group consisting of acrylic acid, methacrylic acid, or their bath soluble salt, and combinations thereof.

Additionally, an aqueous acid electroplating bath containing stannous ions and sulfuric acid for producing electrodeposits of tin, comprises: from about 0.005 to about 0.5 grams per liter of bath solution of a primary brightener, said primary brightener being a disubstituted naphthalene having at least one substituted aldehyde group thereon, with said remaining group other than said aldehyde group being selected from the group consisting of a methyl, hydroxy methyl, and carboxylic acid.

BEST MODE FOR CARRYING OUT THE INVENTION

According to the concepts of the present invention, it has been found that bright electrodeposits can be obtained from an aqueous acid tin plating bath when the oxidation product of a disubstituted naphthalene which is a disubstituted naphthalene having at least one substituted aldehyde group thereon is utilized as a primary brightener. It has also been found that these primary brighteners act synergistically with acrylic acid and methacrylic acid to produce extremely uniform, bright electrodeposits of tin. The effect is truly synergistic in that the results obtained with this combination far exceed those of using the two types of compounds separately.

The disubstituted naphthalene has at least one substituted aldehyde group thereon. The remaining group can either be an aldehyde, a methyl, hydroxy methyl, or carboxylic acid. Such product can be made via different chemical reactions set forth herein in Examples 1, 2 and 3. Regardless of the exact reaction procedure, the disubstituted naphthaldehyde produced will be a combination of various disubstituted naphthaldehydes substantially all of which will have at least one aldehyde group thereon.

Example 1 relates to one method of preparing the primary brightener of the present invention.

EXAMPLE 1

Primary Brightener Via Oxidation of Dimethylnaphthalene

To a reaction vessel equipped with a stirring mechanism and reflux condenser is added 26.1 grams of manganese dioxide, 100 ml. of water, 29.4 grams of concentrated sulfuric acid, and 7.9 grams of dimethylnaphthalene (a mixture of isomers obtained from Aldrich Chemical).

The mixture is heated at reflux (about 220° F.) for 2 hours. The mixture is then steam distilled and the primary brightener separates from the distillate and is collected.

The oxidizing agent utilized to produce the product of Example 1 can be any of a number of oxiding agents well known to the art and to the literature. Specific examples include manganese dioxide, chromic acid, and the like. Moreover, oxygen can even be utilized in the presence of a catalyst such as selenium. The amount of oxidizing agent is generally 2 to 6 moles with from about 2 to 4 moles being preferred for every mole of dimethylnaphthalene. The oxidation reaction generally takes place in an aqueous solution containing a strong acid such as sulfuric acid. The amount of acid is generally from about 2 to about 6 moles for every mole of dimethylnaphthalene. The temperature of the oxidation reaction is usually from about 150° F. to about 220° F. with from about 180° F. to about 220° F. being preferred. Reaction time generally varies from about 1 to about 5 hours with from about 1 to about 2 hours being preferred. Manganese dioxide in the presence of sulfuric acid is preferred in the present invention because the reaction is easily controlled so that not all methyl groups are completely oxidized to carboxylic acids. A certain portion of aldehyde groups will remain as intermediate oxidation products.

Example 2

Primary Brightener Via Chloromethylation of Naphtholic Acid Followed by Reaction with Hexamethylene Tetramine A mixture of 34.4 grams of 1-naphthoic acid, 11.0 grams of paraformaldehyde, 78 ml. of glacial acetic acid, 16.5 ml. of phosphoric acid, and 36.1 ml. of concentrated hydrochloric acid are refluxed for four hours. The mixture is allowed to cool and the insoluble oil is washed several times with equal portions of water. The oil layer is then added to 50 ml. of glacial acetic acid along with 56 grams of hexamethylene tetramine. This mixture is refluxed for two hours followed by an addition of 33 ml. of concentrated hydrochloric acid. The mixture is refluxed for 15 more minutes and is allowed to cool. Upon cooling, the desired primary brightener crystallizes out and is collected.

The methods used in Example 2 are those described in Organic Synthesis, Collective Volume 3, P. 195–197, and Organic Synthesis, Collective Volume 4, P. 690–693 for the synthesis of 1-naphthaldehyde. While these are the preferred amounts of ingredients used to obtain the primary brightener, they may be varied by as much as 50 percent and still be within the scope of this invention.

EXAMPLE 3

Distillation of 1,8-naphthalic Acid Anhydride In Presence of Calcium Hydroxide and Calcium Formate One hundred grams of 1,8-naphthalic acid anhydride, 200 grams of calcium hydroxide, and 200 grams of calcium formate are heated until no more vapors are emitted from the solid mixture. These vapors are subsequently condensed and collected. Yield: 50 grams of crude primary brightener.

This reacton product can also be made with naphthalene dicarboxylic acids and their salts and other naphthalic anhydrides. One to about six moles of calcium hydroxide and calcium formate are used for every mole of naphthalene dicarboxylic acid or naphthalic acid anhydride present.

The use of calcium formate can be omitted in this reaction but the product obtained is not as effective as a primary brightener compared to the product obtained when the calcium formate is used. Other alkalis can be used in place of the calcium hydroxide, but yields of product are much lower due to the formation of resinous bi-product. The reaction without calcium formate and with other alkalis such as potassium hydroxide and sodium hydroxide are still considered part of this invention.

The brightener solution generally contains a solvent such as water, aliphatic alcohols, and glycol ethers; an emulsifying agent; an acid such as acrylic acid, methacrylic acid or their bath soluble salts; and a primary brightener. The amount of primary brightener in the brightener solution generally ranges from about 0.5 to about 25 percent by weight. In the plating bath, the amount of brightener generally ranges from about 0.005 grams to about 0.5 grams per liter of plating bath.

Since the primary brighteners of this invention exhibit limited solubility in the plating bath, emulsifying agents generally must be used to disperse them. A brightener solution may therefore contain from about 1 percent to about 96 percent by weight, and preferably from about 20 percent to about 50 percent by weight of a conventional emulsifying agent based upon the total weight of the mixture. The types of emulsifying agents can be anionic, nonionic, cationic, amphoteric, and mixtures thereof. They are used in the plating bath in a concentration of from about 2 to about 40 grams per liter, desirably from about 2 to about 10 grams, with an optimum amount being from about 3 to about 5 grams per liter.

The preferred emulsifying agents have been found to be the nonionics and modified nonionics. By modified nonionic, it is meant a polyethoxylated compound to which has been added one or more cationic groups, one or more anionic groups, or both. The nonionic emulsifying agents are generally made by condensing ethylene oxide with lipophilic groups such as long chain fatty alcohols, long chain fatty amines, long chain fatty acids, and long chain alkyl phenols, the long chain containing from 2 to about 30 carbon atoms, and preferably from 6 to 15 carbon atoms. The optimum amount of ethylene oxide is about 10 to 30 moles per lipophile. While these nonionics are highly preferred, it is not meant to limit the invention to these types only. For example, ethylene oxide derivatives of naphthols and polysaccharides also perform satisfactorily. In addition, propylene oxide condensates and ethylene oxide-propylene oxide block copolymers are also considered part of the present invention. The modified nonionic emulsifying agents have increased solubility in the plating bath.

Some of the commercially available emulsifying agents of this invention are Surfonic N-150 made by Texaco Chemical Corp., Tergitol TMN made by Union Carbide Corp.; Tetronic 504 made by BASF Wyandotte, Inc.; and Triton QS-15 made by Rohm and Haas, Inc.

Acrylic acid, methacrylic acid, and their bath soluble salts are used in a concentration of from about 0.02 to about 5 grams per liter, preferably from about 0.02 to about 1.0 grams per liter of bath to act synergistically with the primary brighteners of this invention in producing bright deposits of tin that are extremely uniform. By bath soluble salts, it is meant that the acrylic acid and the methacrylic acid is simply neutralized with a bath compatible base, such as NaOH, KOH, or $NH_4OH$. They may also be a part of a brightener solution or composition containing the primary brightener and from about 1 to about 97 percent by weight, desirably 5 to 30 percent by weight, of the acrylic acid, methacrylic acid, or their bath soluble salts. Of course, the emulsifying agent may also be added to this composition wherein the amount of emulsifying agent range is the same as set forth above. A preferred composition or solution of the present invention contains all four components—primary brightener, acrylic or methacrylic acid, an emulsifying agent and even a suitable solvent such as methyl alcohol, ethyl alcohol, or a glycol ether. The amount of solvent can range from about 1 to about 80 percent by weight.

It has also been found that additional brightness can be obtained by the addition of from about 0.01 to about 0.5 grams per liter of bath of at least one of the following aromatic aldehyde compounds: 2-chlorobenzaldehyde, 2,6-dichlorobenzaldehyde, 2,4-dichlorobenzaldehyde, and 2-hydroxy-1-naphthaldehyde.

While the brightening compositions or solutions of this invention are effective in many aqueous acid tin plating bath formulations, it is preferred to use any of the basic baths described in the following examples. In general, a source of stannous ions such as stannous sulfate is present. A suitable amount is from about 10 to about 100 grams per liter. Also present is sulfuric acid in a concentration of from about 50 to 260 grams per liter. The plating baths used in the following examples all contained 180 grams of sulfuric acid per liter and 30 grams of stannous sulfate per liter.

EXAMPLE 4

| | |
|---|---|
| Surfonic N-150 (nonylphenol polyethoxylate) | 4 gms./liter |
| Acrylic Acid | 0.1 gms./liter |
| Product from Example 1 | 0.1 gms./liter |

EXAMPLE 5

| | |
|---|---|
| Tergitol TMN (linear alcohol polyethoxylate) | 4 gms./liter |
| Methacrylic Acid | 0.6 gms./liter |
| Product from Example 2 | 0.1 gms./liter |

EXAMPLE 6

| | |
|---|---|
| Ethoxylated Beta-Naphthol (12 moles ethylene oxide) | 4 gms./liter |
| Methacrylic Acid | 0.6 gms./liter |
| Product from Example 3 | 0.2 gms./liter |

All testing was done in a conventional 267 ml. Hull Cell, using steel cathode panels and tin anodes. A current of 2 amperes was used for 5 minutes at temperatures ranging from 70° to 85° F. Some mechanical agitation was used to prevent gas streaking. The results of the tests using examples 4 through 6 are discussed in TABLE 1.

TABLE I

Results of Plating Tests

| | |
|---|---|
| Test 1 | |
| The plating bath of Example 4 | Bright deposit from 0 to well over 150 amps. per sq. ft. |
| Test 2 | |
| The plating bath of Example 5 | Bright deposit from 5 to well over 150 amps. per sq. ft. |
| Test 3 | |
| The plating bath of Example 6 | Extremely bright deposit from 0 to well over 150 amps. per sq. ft. |
| Test 4 | |
| The plating bath of Example 4, but with no product from Example 1 | Dull, course deposits from 0 to well over 150 amps per sq. ft. |

Having thus described this invention in such full, clear and concise, and exact terms as to enable any person skilled in the art to which it pertains to make and use the same, and having set forth the best mode contemplated of carrying out this invention, in accordance with the patent statutes, the subject matter which is regarded as being my invention is particularly pointed out and distinctly claimed in the appended claims.

What is claimed is:

1. A tin plating brightening composition comprising;

from about 0.5 to about 25 percent by weight of a primary tin brightener, said primary tin brightener being a disubstituted naphthalene having at least one substituted aldehyde group thereon, with said remaining group other than an aldehyde group being selected from the group consisting of methyl, hydyroxy methyl, and carboxyl; and, from about 1 to about 97 percent by weight of a compound selected from the group consisting of acrylic acid, methacrylic acid, or their bath soluble salt, and combinations thereof.

2. The tin plating brightening composition according to claim 1, including from about 1 to about 96 percent by weight of at least one emulsifying agent selected from the group consisting of nonionic, modified nonionic, cationic, anionic, and amphoteric emulsifying agents, and combinations thereof.

3. The tin plating brightening composition according to claim 2, including from about 1 to about 80 percent by weight of a solvent.

4. The tin plating brightening composition according to claim 3, wherein said remaining substituted group is carboxyl.

5. The mixture according to claim 4, wherein said emulsifying agent is selected from the group consisting of a nonionic and a modified nonionic emulsifying agent.

6. The mixture according to claim 5, wherein said acid is methacrylic acid, or its bath soluble salt.

7. An aqueous acid electroplating bath containing stannous ions and sulfuric acid for producing electrodeposits of tin, comprising:

from about 0.005 to about 0.5 grams per liter of bath solution of a primary brightener, said primary brightener being a disubstituted naphthalene having at least one substituted aldehyde group thereon, with said remaining group other than said aldehyde group being selected from the group consisting of methyl, hydroxy methyl, and carboxyl.

8. An aqueous acid electroplating bath according to claim 7, wherein the amount of the stannous ions is from about 10 grams to about 100 grams per liter of bath solution and wherein the amount of sulfuric acid is from about 50 to about 260 grams per liter of said bath solution.

9. The bath according to claim 8, including from about 2 to about 40 grams per liter of an emulsifying agent, said emulsifying agent is selected from the group consisting of nonionic, modified nonionic, anionic, cationic, and amphoteric emulsifying agents, and combinations thereof.

10. The bath according to claim 9, including from about 0.02 to about 5 grams per liter of a compound selected from the group consisting of acrylic acid, methacrylic acid, and combinations thereof.

11. The bath according to claim 10, wherein said emulsifying agent is selected from the group consisting of a nonionic and a modified nonionic emulsifying agent.

12. The bath according to claim 11, wherein said remaining substituted group is carboxyl.

13. The bath according to claim 9, including from about 0.01 to about 0.5 grams per liter or bath of at least one compound selected from the group consisting of 2-chlorobenzaldehyde, 2,6-dichlorobenzaldehyde, 2,4-dichlorobenzaldehyde, and 2-hydroxyl-1-naphthaldehyde.

* * * * *